US008662167B2

(12) United States Patent
Wildhack et al.

(10) Patent No.: US 8,662,167 B2
(45) Date of Patent: Mar. 4, 2014

(54) WEAR-RESISTANT SEPARATING DEVICE FOR REMOVING SAND AND ROCK PARTICLES

(75) Inventors: Stefanie Wildhack, Kempten (DE); Armin Kayser, Buchenberg (DE); Samuel Joly, Durach (DE); Siegfried Müssig, Copenhagen (DK); Klaus Wahrmann, Sprockhövel (DE); Fabian Pöhling, Bochum (DE)

(73) Assignees: ESK Ceramics GmbH & Co. KG, Kempten (DE); Maersk Olie Og Gas AS, Copenhagen K (DK)

( * ) Notice: Subject to any disclaimer, the term of this patent is extended or adjusted under 35 U.S.C. 154(b) by 184 days.

(21) Appl. No.: 13/126,724

(22) PCT Filed: Mar. 31, 2010

(86) PCT No.: PCT/EP2010/002080

§ 371 (c)(1),
(2), (4) Date: May 26, 2011

(87) PCT Pub. No.: WO2011/120539

PCT Pub. Date: Oct. 6, 2011

(65) Prior Publication Data

US 2012/0018146 A1 Jan. 26, 2012

(51) Int. Cl.
*E21B 43/08* (2006.01)

(52) U.S. Cl.
USPC ..... 166/244.1; 166/235; 166/230

(58) Field of Classification Search
USPC ..... 166/244.1, 230, 235, 227, 157, 278
See application file for complete search history.

(56) References Cited

U.S. PATENT DOCUMENTS 1,533,747 A * 4/1925 Lough ..... 166/235
1,705,848 A * 3/1929 Austin ..... 166/235

(Continued)

FOREIGN PATENT DOCUMENTS

DE 2 016 383 A1 5/1971
DE 39 13 986 A1 11/1989

(Continued)

OTHER PUBLICATIONS

International Search Report for International Application No. PCT/EP2010/002080, with a mailing date of Oct. 25, 2010, four (4) pages.

(Continued)

*Primary Examiner* — Daniel P Stephenson
(74) *Attorney, Agent, or Firm* — Nath, Goldberg & Meyer; Jerald L. Meyer; Scott C. Langford

(57) ABSTRACT

A separating device for removing sand and rock particles, and is an integral component of extraction equipment for extraction of liquids or gases from deep wells, having at least one ceramic filter module comprising: an annular stack of annular discs, the upper side of which has at least three elevations uniformly distributed over the circumference of the discs, the discs are stacked such that a separating gap for the removal of sand and rock particles is present between the individual discs, a coupling-on element at the upper end and a coupling-on element at the lower end of the annular stack, a clamping device bracing the annular stack, an outer cage, a coupling element at the upper end and a coupling element at the lower end of the filter module connecting the filter module to further components of the extraction equipment.

41 Claims, 10 Drawing Sheets

(56) References Cited

U.S. PATENT DOCUMENTS

| | | | | | |
|---|---|---|---|---|---|
| 1,709,222 | A | * | 4/1929 | Lawlor et al. | 166/235 |
| 1,995,850 | A | * | 3/1935 | Harter | 166/235 |
| 2,049,336 | A | | 7/1936 | Stine | |
| 2,250,871 | A | * | 7/1941 | Lumbert | 166/235 |
| 2,314,477 | A | * | 3/1943 | Bodey, Jr. | 166/234 |
| 2,746,552 | A | * | 5/1956 | Grospas | 166/235 |
| 3,009,519 | A | | 11/1961 | Brown | |
| 3,568,842 | A | * | 3/1971 | Bozek | 210/307 |
| 3,789,924 | A | * | 2/1974 | Aaltonen et al. | 166/105.1 |
| 3,822,744 | A | * | 7/1974 | Reijonen et al. | 166/235 |
| 4,102,395 | A | * | 7/1978 | Robinson | 166/231 |
| 4,267,045 | A | * | 5/1981 | Hoof | 210/322 |
| 4,752,394 | A | | 6/1988 | McKenzie et al. | |
| 4,753,731 | A | * | 6/1988 | Drori | 210/492 |
| 5,122,271 | A | * | 6/1992 | Simon et al. | 210/314 |
| 5,249,626 | A | | 10/1993 | Gibbins | |
| D365,139 | S | * | 12/1995 | Gibbins | D23/209 |
| 5,515,915 | A | | 5/1996 | Jones et al. | |
| 5,624,560 | A | | 4/1997 | Voll et al. | |
| 5,890,533 | A | | 4/1999 | Jones | |
| 6,382,318 | B1 | | 5/2002 | Whitlock | |
| 6,769,484 | B2 | * | 8/2004 | Longmore | 166/207 |
| 8,196,653 | B2 | * | 6/2012 | Fripp et al. | 166/235 |
| 8,302,681 | B2 | * | 11/2012 | Fripp et al. | 166/235 |
| 2004/0050217 | A1 | | 3/2004 | Heijnen et al. | |
| 2012/0018146 | A1 | * | 1/2012 | Wildhack et al. | 166/244.1 |

FOREIGN PATENT DOCUMENTS

| | | | |
|---|---|---|---|
| DE | 39 20 098 | A1 | 3/1990 |
| WO | 99/06669 | A1 | 2/1999 |
| WO | 2004/099560 | A1 | 11/2004 |
| WO | 2008/080402 | A1 | 7/2008 |

OTHER PUBLICATIONS

Salmang, H. et al., "Ceramics," Rainer Telle 7th edition, 2007, pp. 1-8.

Kollenberg, W., "Technical Ceramics," Fundamentals, Materials, Process Technology, 2nd edition, 2009, pp. 1-3.

Basu, B. et al., "Advanced Structural Ceramics," The American Ceramic Society, 2011, pp. 3-7.

Schubert, U. et al., "Synthesis of Inorganic Materials," Wiley-VCH, 2000, pp. 1-2.

* cited by examiner

WEAR-RESISTANT SEPARATING DEVICE FOR REMOVING SAND AND ROCK PARTICLES

This is a National Phase Application filed under 35 U.S.C. §371 as a national stage of PCT/EP2010/002080, filed on Mar. 31, 2010, the content of which is hereby incorporated by reference in its entirety.

FIELD OF THE INVENTION

The invention relates to a novel separating device with improved erosion and abrasion resistance, which is suitable as an integral component part of extraction equipment for use in the extraction of oil, water and gas mixtures or the individual components thereof from deep wells, with the aid of which solids such as sand and rock particles can be removed from the liquids and gases to be extracted. The separating device serves in particular for preventing the corrosive and abrasive wearing of the extraction equipment by sand and rock particles. At the same time, the separating device is corrosion-resistant with respect to treatment fluids.

BACKGROUND OF THE INVENTION

In the extraction of liquids and gases, such as mineral oil and natural gas, from deep wells, there is often the problem that influxes of sand from the oil and gas deposits make extraction more difficult. This is the case in particular whenever hydrocarbon production takes place from unconsolidated formations of oil and gas deposits or whenever, as the lifetime of the deposits becomes greater, there is an increase in the flow rates, and consequently in the incursion of water in hydrocarbon production, and the influx of sand is initiated, so that particles from the deposits are increasingly extracted at the same time.

To combat influxes of sand from the deposits, special filter equipment is used, such as for example slot filters or filters with metal wire windings, which generally consist of steel materials and have the disadvantage that, on account of the high flow forces, they can no longer perform their task of separating out the sands, since they erode quickly. This is remedied by regularly exchanging the sand filter device, which is carried out when "working over" the well.

PRIOR ART

Usually woven metal wire meshes, metal wire grids or metal wire windings are used for this task. A solution with a woven wire mesh is described in U.S. Pat. No. 5,624,560. These solutions with woven wire meshes or wire grids are also carried by a metal supporting structure, such as a perforated tube, to remain mechanically stable.

In U.S. Pat. No. 5,890,533, a solution with a wire winding is described, it being possible for a number of filter units with metal wire windings to be connected to one another by way of connecting elements with screw threads.

In U.S. Pat. No. 5,515,915, a solution with a wire winding on a perforated tube is described, spacing and supporting rods also being fitted between the inner perforated tube and the wire winding to support the wire winding. There is also a filter gravel pack additionally provided between the perforated tube and the wire winding. This filter gravel pack serves as a secondary filter.

A major disadvantage of these constructions with metal woven wire meshes, wire grids or wire windings is their low resistance to wear. On account of the abrasive or erosive effect of the sand and rock particles flowing in at a high flow velocity, the filters are destroyed and the extraction pipes are damaged. At the same time, the productivity of the extraction decreases, since the sand is no longer effectively filtered out but is transported further with the extraction medium. A further problem is the corrosive wear occurring on the filters and extraction pipes as a result of the use of treatment fluids. This corrosive wear in turn exacerbates the abrasive wear. Treatment fluids, such as for example acids, bases, water or hot steam, are used for cleaning the separating device and for stimulating the well.

It is necessary to improve the resistance of the well equipment to abrasive or erosive wear and to ensure that it is not corrosively attacked.

US2004/0050217 A1 and WO2008/080402 A1 describe solutions in which, instead of the metal slotted hole screens, separating devices of porous permeable materials are used. The porous filtering materials of US2004/0050217 A1 may be metallic, ceramic or organic; in WO2008/080402 A1, porous ceramic materials are used.

One problem of the solutions described in these two documents is that, on account of their low fracture toughnesses, filters of porous ceramic materials tend to fracture as a result of flexural loading. The ultimate bending strength is generally well below 30% of that of the corresponding solid material and is therefore not sufficient for the mechanical loads under the operating conditions in wells drilled in rock.

A further problem is that the abrasion resistance of porous ceramic materials is much less than that of solid ceramic materials.

A further solution with a separating device of porous materials, which likewise has the disadvantages described above, is described in WO2004/099560 A1. In a further embodiment (page 7, line 24-page 8, line 2 and Claim 20), WO2004/099560 A1 envisages protecting a conventional sand filter on the outside by a sleeve of erosion-resistant, solid rings, which additionally have ribs or grooves on their upper and lower surfaces. On the rings stacked one on top of the other there forms a tortuous fluid channel, on the walls of which the energy of the medium flowing through is reduced by impact, so that the wear of the conventional sand filter lying thereunder is reduced. The rings are preferably formed from carbides or nitrides such as silicon carbide or tungsten carbide. A disadvantage of this solution is that the improved wear protection is accompanied by an energy dissipation of the flowing medium; the outer sleeve does not act as a filter but as a flow resistance, which worsens the output. It is not disclosed how the sleeve is fastened on the extraction pipe.

U.S. Pat. No. 5,249,626 presents a cylindrical screen filter, which comprises a multiplicity of stacked, annular filter segments. The annular stack is held together by a number of threaded rods with threaded nuts or else double nuts of high-grade steel respectively at the upper and lower ends. The separation of the particles takes place at the variable annular gap, which is formed between opposing filter segments. The rings are of plastic, preferably of glass-reinforced polypropylene (column 4, lines 50-54). The threaded rods are guided through openings provided for them in the rings (column 4, lines 31-33). This solution cannot be realized from ceramics. The cross-sectional transitions are angular; the filter segments are of a design typical for plastics. The central lead-throughs for the threaded rods would weaken ceramic elements and reduce the load-bearing capacity. The spacers are of a flat form; they do not allow compensation for flexural stresses. Further disadvantages of the screen filter described in U.S. Pat. No. 5,249,626 of glass-reinforced polypropylene are its insufficient erosion/abrasion resistance and insufficient corrosion resistance.

In WO 99/06669, a further solution with a spirally wound metal wire winding is described. Furthermore, for a second embodiment (page 3, lines 8-14 and page 10, lines 8-19), rings are formed from the V-shaped wire by welding. These rings are then connected to one another by way of spacers with upper and lower surfaces, the spacers being fixedly connected by their upper surface to the upper wire ring and by their lower surface to the lower wire ring by welding, so that a mechanically solid and rigid structure is obtained. The possibility of also using ceramic for this structure is mentioned. However, in the case of ceramic, the rigid configuration with the fixedly connected flat-form spacers would have the effect that tensile and flexural stresses occurring could not be absorbed, which would lead to a considerable risk of fracture and possible complete destruction of the sand filter. Moreover, the production of such a construction from ceramic would be very complex.

OBJECT OF THE INVENTION

While overcoming the disadvantages of the prior art, the invention is based on the object of providing a separating device for removing sand and rock particles in the extraction of liquids or gases from wells drilled in rock, which has better wear or abrasion resistance and a lower tendency to fracture than the separating devices known in the prior art, and which moreover is corrosion-resistant to treatment fluids, and which can withstand the loads occurring during extraction, has a longer service life and with the aid of which higher extraction rates can be achieved. The separating device is additionally intended to be suitable as an integral component part of extraction equipment for the extraction of liquids or gases.

SUMMARY OF THE INVENTION

The above object is achieved according to the invention by a separating device according to Claim 1 and the use thereof according to Claim 27. Advantageous and particularly expedient refinements of the subject matter of the application are specified in the subclaims.

The subject matter of the invention is consequently a separating device for removing sand and rock particles which is suitable as an integral component part of extraction equipment for the extraction of liquids or gases from deep wells, the separating device comprising at least one ceramic filter module, the filter module comprising a) an annular stack of brittle-hard annular discs, the upper side of which has at least three elevations uniformly distributed over the circular circumference of the discs, the discs being stacked and braced in such a way that a separating gap for the removal of sand and rock particles is present in each case between the individual discs, b) a coupling-on element at the upper end and a coupling-on element at the lower end of the annular stack, c) a clamping device for the axial bracing of the annular stack, d) an outer cage for the mechanical protection of the filter module, e) a coupling element at the upper end and a coupling element at the lower end of the filter module for connecting the filter module to further components of the extraction equipment.

The subject matter of the invention also covers the use of the separating device according to the invention for removing sand and rock particles in a process for extracting liquids or gases from wells drilled in rock or deep wells.

The annular discs of the separating device according to the invention are stacked and braced in such a way that they are axially fixed and a defined separating gap for removing sand and rock particles forms in each case between individual discs. In the radial and tangential directions, however, the rings are movable to a certain degree with respect to one another, whereby a buildup of stress in the annular stack as a result of external loads such as bending is effectively reduced.

The annular stack is merely fixed within itself by way of the clamping device, the sand filter module does not require any additional mechanical support. For example, it is not fastened on an inner extraction pipe which bears the dead weight of the annular stack and the clamping device and possibly further coupling elements, intermediate modules and/or the filter module tip.

In a preferred embodiment, the separating device also comprises one or more protective enclosures for protecting the intermediate modules and the coupling elements.

The separating device according to the invention, constructed from brittle-hard annular elements, is more abrasion- and corrosion-resistant than conventional sand combating devices. It therefore has a longer service life in comparison with the sand filters of the prior art. By contrast with the sand filters of the prior art, the separating device according to the invention therefore does not have to be exchanged at regular intervals, so that the intervals before which an existing well has to be worked over become much longer.

On account of the more effective filtration in comparison with the filters of the prior art, i.e. the better sand removal, higher extraction rates can be achieved.

The structural solution suitable for ceramics that is provided by the present invention allows it to use the favourable material properties of ceramic materials, in particular their abrasion resistance and their high deformation resistance, for the sand filters that are subjected to high abrasive loading. The unfavourable loads for this class of material, in particular point, flexural, tensile and impact loads, are avoided in the structural design by the solution according to the invention.

By contrast with the prior art (such as for example in U.S. Pat. No. 5,515,915), on account of the high resistance of the brittle-hard annular discs to deformation, the annular discs do not have to be supported by spacing and supporting rods on their inner pipe in order to increase their stability in the stack and in relation to one another. They can be of a free-standing construction.

As soon as the annular discs are axially braced, they form a very stable separating gap, which has a small tolerance band, caused only by the production tolerance of the rings and not by material deformability. The tolerances of the separating gap widths are in this case in conformity with the standard guidelines of the API (American Petroleum Institute) and can even exceed these standards.

The high resistance to mechanical deformation, for example caused by collapsing layers of sand, prevents the separating gaps from changing. By contrast with the sand filters of the prior art of woven wire meshes and wire windings, clogging of the separating gaps is prevented.

Even when there is an abrupt influx of sand, the brittle-hard annular discs do not deform, the set separating gap width is retained.

In the case of metal woven filter meshes according to the prior art, multi-ply filter fabrics are customary and necessary for protecting the fine filter. However, the multi-ply fabric arrangement has the effect of increasing the flow resistance. Multi-ply fabrics also tend to become clogged by sands becoming deposited in the openings, and consequently tend to cause further increased flow resistance. By contrast with this, on account of the good abrasion resistance and the high deformation resistance of the brittle-hard annular stack, the ceramic sand filter modules according to the invention are of a single-ply configuration and are subjected directly to the stream extracted. An additionally introduced filter gravel pack between the filter and the inner pipe as a secondary filter is also not necessary in the case of the ceramic sand filter modules according to the invention. Instead, the sand and rock particles to be removed can build up as a secondary filter cake on the outer circumferential surface of the stable, brittle-hard annular discs. The stability thereof is promoted by the separating device according to the invention, which leads to an increase in the integrity of the drilled well.

The removal of the particles in direct oncoming and passing-through flow is ensured, without the flow being adversely influenced by deflection or energy dissipation. The pressure loss of the separating device according to the invention is negligible and the separating device according to the invention is flowed through in a laminar manner.

A further advantage is that the separating device according to the invention does not require any mechanical support such as that required by the plastic filter segments in U.S. Pat. No. 5,0249,626 or the metal wire grids of U.S. Pat. No. 5,624,560. The annular stack according to the invention is merely fixed within itself by way of the clamping device and is not supported or carried by an inner extraction pipe. Since the inner extraction pipe is no longer needed, consequently the free extraction cross section that is internally present is increased, and so too is the extraction rate.

The resilient mounting of the annular stack makes it possible that bends can be absorbed and compensation can be provided for different thermal expansions of the different materials.

The rings are stacked and braced in such a way that they are movable to a degree with respect to one another in the radial and tangential directions, whereby a buildup of stress in the annular stack as a result of external loads such as bending is effectively reduced.

The coupling elements allow conventional intermediate modules to be used. The sand filter modules may be fastened to existing extraction units by conventional connection technology. This applies both to the fastening to the end of the extraction pipe string and to subsequent pushing-in of the filter modules and suspension on a landing nipple.

The individual sand filter modules may be connected by way of the coupling elements and intermediate modules to form filter systems of any desired length.

The separating device according to the invention can be used with any deviation of the drilled well, both in a horizontal well and in a vertical well, and also under any other well inclination, for example under a well inclination of 60°. This is an advantage over the metal wire grids that are conventionally used.

In order not to end prematurely the use of the abrasion-resistant and consequently durable sand filter modules according to the invention as a result of this abrasive damage or destruction of a commercially available filter module tip, the separating device according to the invention preferably comprises filter module tips with increased abrasion protection.

BRIEF DESCRIPTION OF THE DRAWINGS

The invention is explained in more detail on the basis of the drawings, in which FIG. 1 schematically shows the overall view of a separating device according to the invention, including a filter module tip.

DETAILED DESCRIPTION OF THE INVENTION

Preferred embodiments and details of the separating device according to the invention for removing sand and rock particles are explained in more detail below with reference to the drawings.

Figure 1:
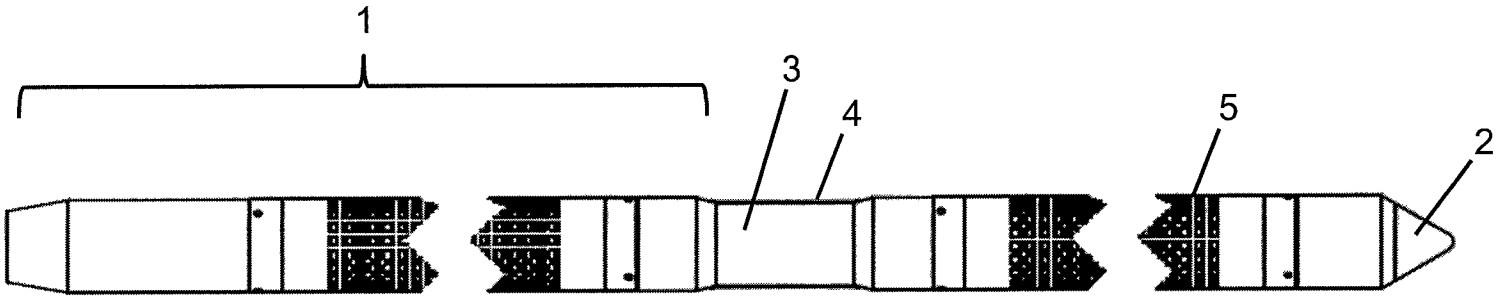

FIG. 1 shows the overall view of a separating device according to the invention, which is made up in a modular manner of at least one ceramic filter module 1 (also referred to hereafter as the "sand filter module").

The modular construction allows the separating device to be extended as desired, in accordance with the conditions of the drilled well. The separating device usually comprises a filter module tip 2 at the lower end of the lowermost sand filter module, and consequently at the end of the drilling pipe string. The ceramic sand filter modules thereby undertake the task of removing the sand or combating the sand.

The sand filter modules may also be connected to further sand filter modules by way of intermediate modules 3. The intermediate modules may perform various tasks, for example ensuring sufficient bending when the separating device is introduced into the drilled well, centering the separating device in the well casing or fastening/anchoring the separating device to the extraction pipe or to the well casing. Active elements, by means of which clogged filter elements can be backflushed or cleared, may also be used as intermediate modules.

The separating device according to the invention may be installed in the extraction system both when newly equipping sand-carrying wells and when working over the well; furthermore, in the case of an existing well, it may also be inserted through the interior of the extraction pipe and anchored to the landing nipples of the well casing. Depending on the operational variant, the intermediate modules and the geometrical date of the ceramic sand filter modules differ, but the structural design principles can be retained.

Various embodiments of the sand filter modules according to the invention are described below, the ceramic sand filter modules always comprising the following basic elements that are designed suitably for the material and so as to match one another:

an annular stack 6 (see FIGS. 4 and 5) of brittle-hard annular discs 7 (see FIGS. 2 and 3), the upper side 16 of which has at least three elevations 8 uniformly distributed over the circular circumference of the discs. The preferred embodiment with three elevations 8 formed as spherical portions prevents the introduction of point loads to the brittle-hard filter rings. The discs are stacked and braced in such a way that they are axially fixed and a defined separating gap 9 for removing sand and rock particles forms in each case between the individual discs. In the radial and tangential directions, however, the rings are movable to a certain degree with respect to one another, whereby a buildup of stress in the annular stack as a result of external loads such as bending is effectively reduced.

two coupling-on elements 10, 11 (see FIGS. 4 and 5) at the upper and lower ends of the annular stack 6;

a clamping device for the axial bracing of the annular stack;

an outer cage 5 (see FIG. 1);

two coupling elements (12, 13 (see FIGS. 6 and 7) at the upper and lower ends of the sand filter module for connecting the sand filter modules to further components of the extraction equipment, such as for example the filter module tip and the intermediate modules.

Annular Stack

The annular discs 7 used in the ceramic sand filter module are represented in FIGS. 2*a* 2*d* and 3*a*-3*d* for two preferred embodiments of the sand filter module. Figure block 2 shows the design of the annular discs for a first embodiment, in which inner clamping rods 14 (see FIG. 6) are used for bracing the annular stack. In a second embodiment, the annular stack is built up and braced on an inner, perforated tube 15 (see FIG. 7); Figure block 3 shows the rings used for this purpose.

The annular discs are produced from a brittle-hard material, preferably from a ceramic material, which is abrasion- and erosion-resistant to the sand and rock particles as well as corrosion-resistant to the extraction media and the media used for cleaning, such as for example acids.

The removal of the sand and rock particles takes place at a radial, preferably narrowing gap 9 (see FIGS. 5 and 6), which forms between two braced annular elements lying one on top of the other. The annular elements are designed suitably for ceramic or suitably for brittle-hard materials, i.e. cross-sectional transitions are configured without notches and the forming of flexural stresses is avoided or compensated within the structural design.

The height (thickness) of the annular discs is dependent on the through-flow rate required.

The annular discs 7 have on their upper side 16 at least three elevations 8 of a defined height uniformly distributed over the circular circumference of the discs, with the aid of which the height of the separating gap (gap width) is set. The elevations are not separately applied or subsequently welded-on spacers. They are formed directly in production during the shaping of the annular discs.

During stacking one on top of the other, the individual elevations are positioned in line one above the other in the stack.

The elevations are preferably given the form of spherical portions, in order to achieve point contact between opposing annular discs and avoid surface-area contacts.

The annular discs preferably have on the outer circumferential surface a clearance/marking groove 17, on the basis of which the annular discs are positioned more easily in line one above the other during installation, thus allowing foolproof assembly. The marking groove is preferably shaped such that it is rounded-off.

The upper side 16 of the annular discs may be configured at a right angle to the disc axis or sloping down inwards or outwards with a planar or curved surface.

The underside 18 of the annular discs may be configured sloping down outwards or inwards, preferably sloping down inwards, more preferably it is formed concavely. An inwardly sloping-down configuration is advantageous with respect to a reduced tendency for the separating device to clog. The concave shaping should be understood as applying to the annular base as a whole, see FIGS. 2*d* and 3*d*. Here, the annular base is configured with a radius R.

The annular discs in the annular stack are movable with respect one another in the radial and tangential directions, whereby a buildup of stress in the annular stack as a result of external loads such as bending is effectively reduced.

Furthermore, possible deviations in shape and size can be easily compensated by the concave shaping of the annular base in combination with the three-point contact.

The cross-sectional form of the annular discs is preferably not rectangular and not trapezoidal on account of the concavely curved surfaces. It also does not have sharp edges and cross-sectional transitions.

Figure 2D:
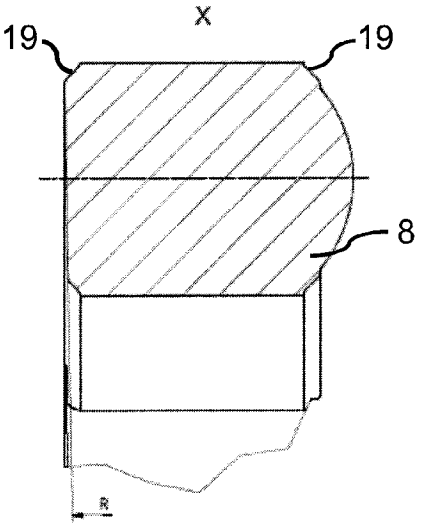
FIGS. 2*a*-2*d* show various views of an annular disc according to the invention as provided by a first embodiment.
Figure 2B:
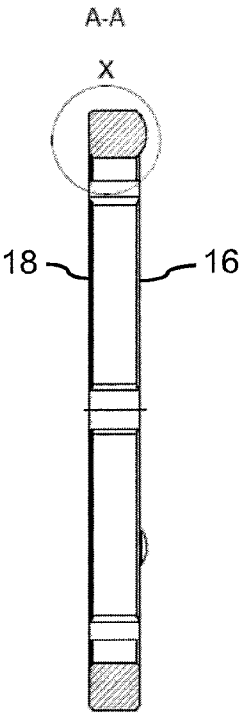
Figure 2C:
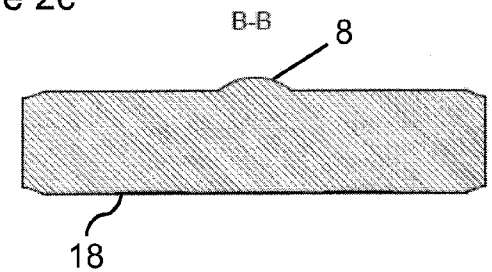
Figure 2A:
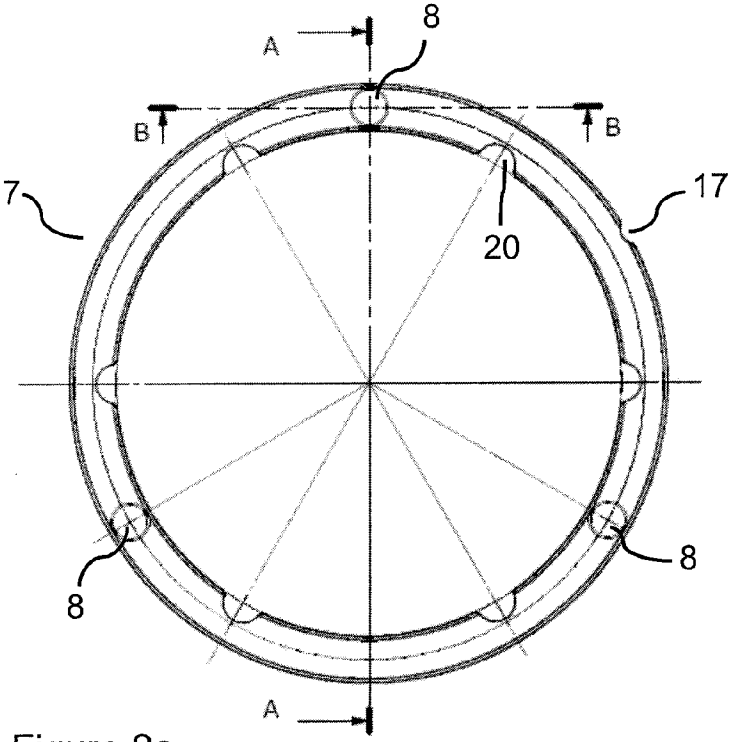
Figure 3D:
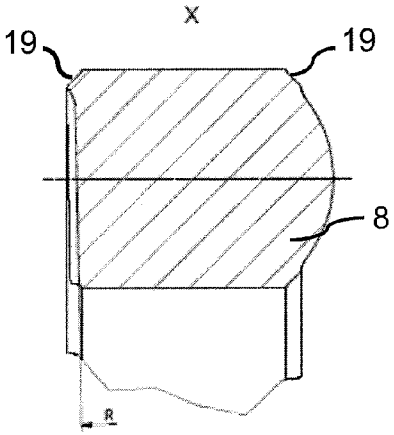
FIGS. 3*a*-3*d* show various views of an annular disc according to the invention as provided by a second embodiment.
Figure 3B:
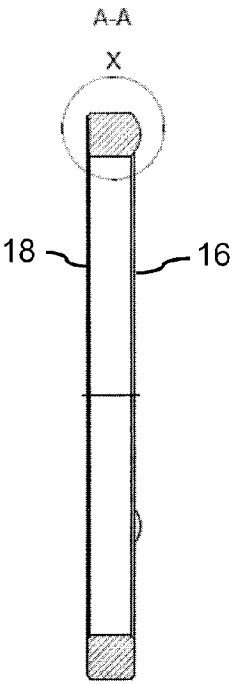
Figure 3C:
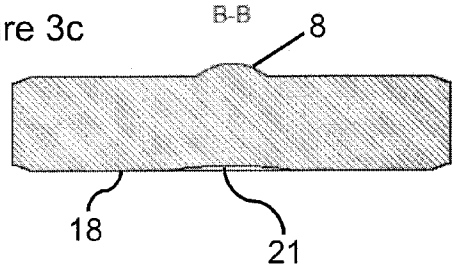

In a preferred embodiment, the outer contours 19 of the annular discs are configured with a bevel, as illustrated in FIGS. 2*d* and 3*d*. According to another preferred embodiment, the edges may also be rounded. This represents still better protection of the edges from the edge loading that is critical for brittle-hard materials.

The circumferential surfaces (lateral surfaces) of the annular discs are preferably cylindrical (planar). However, it is also possible to shape the circumferential surfaces outwardly, for example convexly, in order to achieve a better oncoming flow.

The radial wall thickness of the annular discs is preferably at least 2 mm, more preferably at least 5 mm. The height or thickness of the discs is preferably 1 to 20 mm, more preferably 1 to 10 mm.

The outside diameter of the annular discs is less than the inner diameter of the well or than the inside diameter of the well casing. It is usually 50-200 mm. Diameters smaller than 50 mm and greater than 200 mm are likewise possible.

The inside diameter of the annular discs is preferably less than 90%, more preferably less than 85%, of the outside diameter of the annular discs. Alternatively, the contour of the inside diameter of the annular discs may also be approximated by a polygon, for example a hexagon.

In the case of the embodiment with the clamping rods, attention only has to be paid to the relationship with the outside diameter. In the case of the embodiment with the clamping tube, the inside diameter of the annular discs must additionally be greater than the diameter of the inner, perforated tube. The annular discs must not lie on the inner tube. This ensures that the bending occurring during introduction into the well can be absorbed by way of the construction of the annular disc and a fracture of the ceramic elements is avoided.

In the case of the embodiment with the clamping rods 14 (see FIG. 6), the annular discs preferably have additionally on their inner circumferential surface at least three clearances/grooves 20 (see FIG. 2*a*), which serve for receiving the clamping rods. If the contour of the inside diameter of the annular discs is formed as a polygon, the clearances can be omitted, since the clamping rods can be run in the corners. These clearances 20 are provided offset from the elevations 8 distributed on the upper side. In a preferred embodiment, six grooves 20 have been introduced on the circumferential surface. The three elevations 8 on the upper side 16 are in this case arranged in such a way that they are respectively located in every second intermediate space between two grooves 20. The clearances 20 are preferably shaped such that they are rounded-off (see FIG. 2*a*).

In the case of the embodiment with the clamping tube 15 (see FIG. 7), no clearances/grooves have been introduced on the inner circumferential surface of the annular discs.

In the embodiment with the clamping rods, the discs make very easy assembly possible by means of the grooves on the inside diameter of the annular discs. Since, however, the wall thickness is reduced in the region of the grooves, a reduction in the stability of the ring and consequently restrictions during operation, may occur in the case of this variant, specifically in cases of small diameters of the available well casings and extraction pipes. In the clamping tube variant, on the other hand, the discs have a virtually uniform wall thickness over the entire circular circumference, and can thus be used even under extreme geometrical requirements.

In the case of the embodiment with the clamping tube, on the underside 18 of the rings there are additionally at least three depressions 21 (see FIG. 3*c*), in which the elevations 8 of the opposing upper side of the next annular segment can be positioned. The number and spacing of the depressions depend on the number and spacing of the elevations on the upper side of the ring. The depressions introduced serve as a means for preventing twisting of the rings and assist the self-centering of the rings in the stack.

In the case of the embodiment with the clamping rods, these depressions are not necessary, since here the clamping rods provide sufficient prevention from twisting. Nevertheless, depressions may be introduced on the underside of the ring. Since, however, these involve extra effort in production, they are preferably omitted.

Figure 3A:
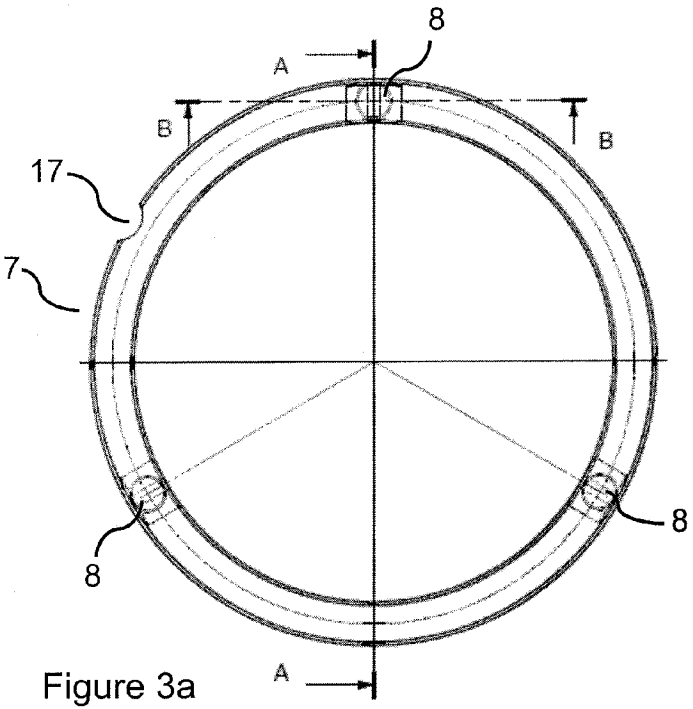

The depressions are preferably areas displaced parallel to the radius R (see FIG. 3*a*). Thus, point contact is also ensured here with respect to the elevations, and possible deviations in shape and size can be compensated by way of the three-point contact. The depressions may also be given the form of spherical or cylindrical portions. A rounded-off trapezoidal form or a wave-shaped structure is also possible.

The gap width 9 (see FIGS. 4 and 5) is chosen according to the sand fraction to be separated. The gap width is at the smallest at the outside diameter, in order to avoid clogging of the annular gap. The gap width is set by way of the height of the elevations on the upper side of the ring, the depth of the depressions on the underside of the ring (if present) and the form of the underside of the ring, i.e. by way of the radius of the concavely curved surface. The gap geometry chosen ensures that the flow processes in the gap are laminar and that the pressure loss between the outside diameter and the inside diameter is small.

The separating device can be backflushed by liquid treatment media, any particles introduced into the separating gap can thus be flushed out.

The brittle-hard material of the annular discs is preferably chosen from oxidic and non-oxidic ceramic materials, mixed ceramics of these materials, ceramic materials with the addition of secondary phases, mixed materials with fractions of ceramic hard materials and with a metallic binding phase, precipitation-hardened casting materials, powder-metallurgical materials with hard material phases formed in situ and long- and/or short-fibre-reinforced ceramic materials.

Examples of oxidic ceramic materials are $Al_2O_3$, $ZrO_2$, mullite, spinel and mixed oxides. Examples of non-oxidic ceramic materials are SiC, $B_4C$, $TiB_2$ and $Si_3N_4$. Ceramic hard materials are, for example, carbides and borides. Examples of mixed materials with a metallic binding phase are WC—Co, TiC—Fe and $TiB_2$—FeNiCr. Examples of hard material phases formed in situ are chromium carbides. An example of fibre-reinforced ceramic materials is C—SiC.

The aforementioned materials are distinguished by being harder than the typically occurring rock particles, that is to say the HV or HRC hardness values of these materials lie above the corresponding values of the surrounding rock. Materials suitable for the ceramic sand filter modules have HV hardness values greater than 15 GPa, preferably greater than 23 GPa.

All these materials are at the same time distinguished by having greater brittleness than typical unhardened steel alloys. In this sense, these materials are referred to herein as "brittle-hard".

In addition, all these materials have a very high deformation resistance, which is reflected in their modulus of elasticity. The high stiffness has a positive effect on the abrasion behavior of the materials. Peeling-off of material and plastic deformation, as in the case of metals, is not possible here.

The construction of the sand filter module is likewise positively influenced by the high resistance to deformation. The annular discs from these materials do not have to be supported by webs on an inner tube in order to increase their stability in the stack and in relation to one another. They can be of a freestanding construction. As soon as they are axially braced, they form a very stable separating gap, which has a small tolerance band, caused only by the production tolerance of the rings and not by material deformability. They do not deform even under abrupt loads; the set separating gap width is retained.

In addition, a very stable, homogeneous filter cake of the inflowing sand can form on the rigid annular elements.

Materials suitable for the ceramic sand filter modules have moduli of elasticity greater than 200 GPa, preferably greater than 350 GPa.

Materials with a density of at least 90%, more preferably at least 95%, of the theoretical density are preferably used, in order to achieve the highest possible hardness values and high abrasion and corrosion resistances. Sintered silicon carbide (SSiC) or boron carbide are preferably used as the brittle-hard material. These materials are not only abrasion-resistant but also corrosion-resistant to the treatment fluids usually used for flushing out the separating device and stimulating the well, such as acids, e.g. HCl, bases, e.g. NaOH, or else steam.

Particularly suitable are, for example, SSiC materials with a fine-grained microstructure (mean grain size<5 μm), such as those known for example under the names EKasic® F and EKasic® F plus from ESK Ceramics GmbH & Co. KG. Furthermore, however, coarse-grained SSiC materials may also be used, for example with a bimodal microstructure, preferably 50 to 90% by volume of the grain size distribution consisting of prismatic, platelet-shaped SiC crystallites of a length of from 100 to 1500 μm and 10 to 50% by volume consisting of prismatic, platelet-shaped SiC crystallites of a length of from 5 to less than 100 μm (EKasic® C from ESK Ceramics GmbH & Co. KG).

The production of the annular discs is possible by means of powder-metallurgical or ceramic processes in automated mass production. The annular discs may be produced by what is known as the net-shape process, in which the annular discs (including elevations) are pressed in near net shape from powders. Complex machining of the annular discs is not required. The deviations in shape and size of the individual annular discs that are to some extent unavoidable in a sintering process are tolerable with a construction of the separating device according to the invention.

The annular discs from brittle-hard materials are assembled together with the coupling-on elements as an annular stack of any desired height. The height of the annular stack, and consequently the length of the sand filter module, is based on the well-dependent diameter requirements, the resulting loads, the required bending and the load-bearing capacity of the metal clamping construction. The preferred height of the annular stack or length of the filter is 1000 mm.

Coupling-on Elements

Figure 4B:
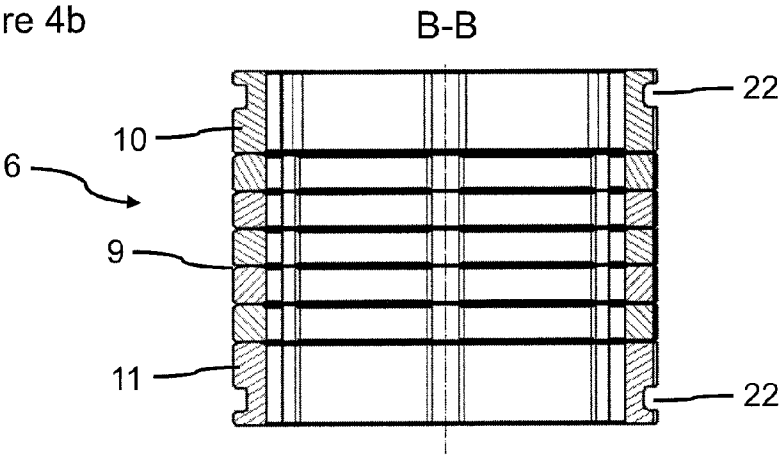
FIGS. 4*a*-4*c* schematically show various views of an annular stack with coupling-on elements as provided by a first embodiment.
Figure 4A:
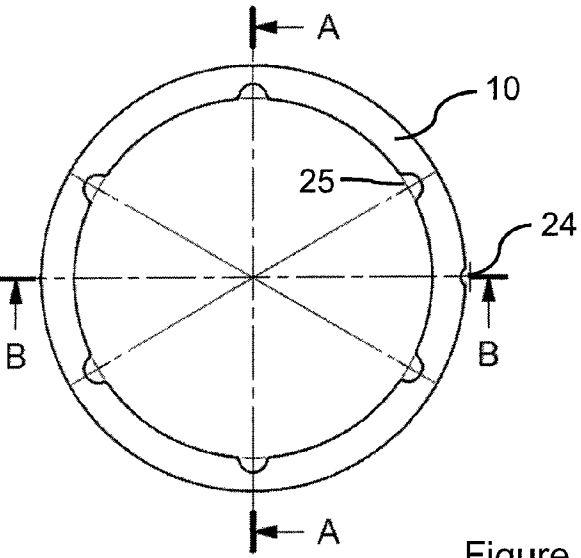
Figure 4C:
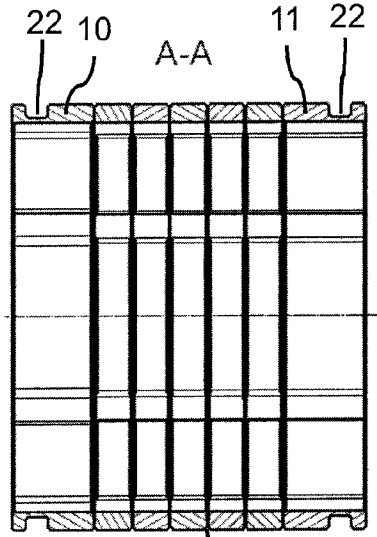
Figure 5B:
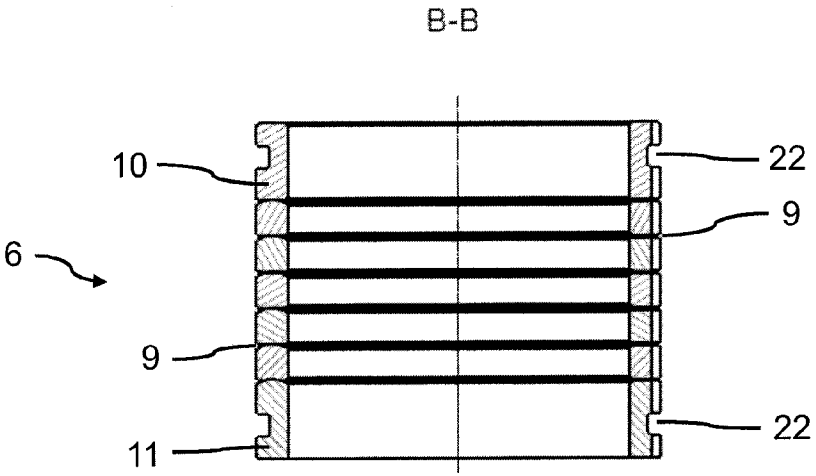
FIGS. 5*a*-5*c* schematically show various views of an annular stack with coupling-on elements as provided by a second embodiment.
Figure 5A:
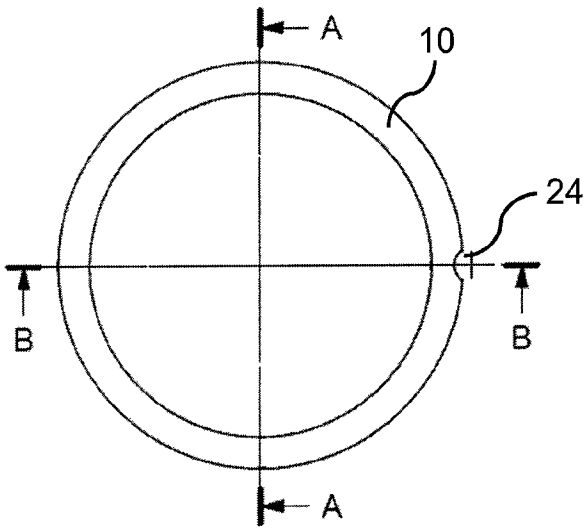
Figure 5C:
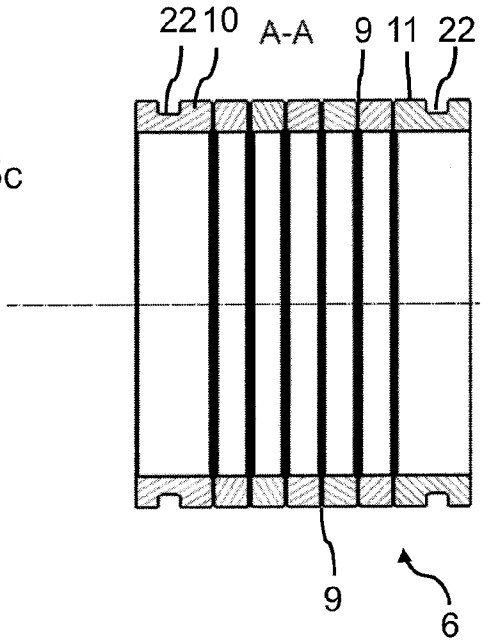

FIGS. 4*a*-4*c* and 5*a*-5*c* show annular stacks 6 according to the invention with the coupling-on elements 10 and 11. FIGS. 4*a*-4*c* show the embodiment with the clamping rods 14 (see FIG. 6). FIGS. 5*a*-5*c* show the embodiment with the inner clamping tube 15 (see FIG. 7). FIGS. 4*a* and 5*a* show plan views of the upper coupling-on elements 10. FIGS. 4*b*, 4*c*, 5*b* and 5*c* are respectively cross-sectional views along in each case the line B-B in FIGS. 4*a* and 5*a* or long in each case the line A-A in FIGS. 4*a* and 5*a*.

The coupling-on elements in each case form the end-side, lateral terminations of the annular stack, by way of which the annular stack is coupled onto the clamping device. They are designed such that the clamping forces are transferred uniformly to the annular stack.

The coupling-on elements are preferably produced from the same material as the rings. Alternatively, however, corrosion-resistant steels and plastics, such as for example fluoroelastomers or PEEK (polyether ketone), may also be used.

The upper surface of the upper coupling-on elements 10, which is directed towards the clamping device, preferably has a planar/flat surface. The surface directed towards the annular stack, that is to say the underside of the coupling-on element 10, is preferably configured with a radius, i.e. is concave like the annular elements. The outer circumferential surface preferably has a peripheral groove 22 (FIGS. 4 and 5) for receiving a sealing ring (O-ring) 23 (in FIGS. 8*a* and 9*a*) as well as preferably a clearance/marking groove 24 (FIGS. 4 and 5) for the positioning of the coupling-on elements with respect to the annular elements. The marking groove 24 is preferably shaped such that it is rounded-off.

The lower surface of the lower coupling-on element 11, which is directed towards the clamping device, preferably has a planar/flat surface. The surface directed towards the annular stack, that is to say the upper side of the coupling-on element 11, has at least three elevations, uniformly distributed over the circular circumference of the discs. The outer circumferential surface preferably has a peripheral groove 22 for receiving a sealing ring (O-ring) 23 (in FIGS. 8*a* and 9*a*) as well as preferably a clearance/marking groove 24 for the positioning of the coupling-on elements with respect to the annular elements. The marking groove 24 is preferably shaped such that it is rounded-off.

The inside diameter of the coupling-on elements corresponds to that of the annular elements. The outside diameter of the coupling-on elements is preferably equal to or greater than that of the annular discs (see FIGS. 4 and 5). As a result of the geometrical conditions, it may however become necessary for structural design reasons that the outside diameter is slightly smaller than the outside diameter of the annular discs. This is only possible, however, if the wall thickness does not go below the smallest wall thickness of 2 mm and the component and handling stability is not put at risk.

In the case of the embodiment according to FIG. 4 with the clamping rods 14, preferably at least three clearances/grooves 25, which serve for receiving the clamping rods, are additionally provided on the inner circumferential surface of the coupling-on elements 10 and 11. These clearances are provided offset from the elevations distributed on the upper side of the annular discs. In a preferred embodiment, six grooves 25 have been introduced on the inner circumferential surface. The three elevations on the upper side are in this case arranged in such a way that they are respectively located in every second intermediate space between two grooves. The clearances 25 are preferably shaped such that they are rounded-off (see FIG. 4*a*).

In the case of the embodiment according to FIG. 5 with the clamping tube 15, no clearances/grooves have been introduced on the inner circumferential surface.

The tolerances of the two coupling-on elements 10, 11 have been chosen closer than those of the annular discs, in order to couple the brittle-hard components optimally onto the metal components of the clamping device; by contrast with the unworked (as-sintered) annular discs, the coupling-on elements must be machined.

In an alternative embodiment, the upper surface of the upper coupling-on element 10 and/or the lower surface of the lower coupling-on element 11 is not formed as planar/flat but as a spring seat. In this way, the compression springs are directly received and additionally protected from the extraction medium.

Clamping Device for Axially Bracing the Annular Stack

The annular discs are mounted together with the coupling-on elements as an annular stack of any desired height and fixed within themselves by means of the clamping device.

The task of the clamping device is to brace within themselves the annular elements stacked axially one on top of the other and to set in a defined manner the separating gap formed between the individual discs. The width of the separating gap preferably has a value in the range from 0.05-1 mm, more preferably 0.05-0.5 mm.

In the sand filter module according to the invention, the annular stack is merely fixed within itself by way of the clamping device, the sand filter module does not require any additional mechanical support. For example, it is not fastened on an inner extraction pipe which bears the dead weight of the annular stack and the clamping device and possibly further coupling elements, intermediate modules and/or the filter module tip. For this reason, the clamping device must be able to absorb the tensile loads resulting from the dead weight.

Figure 6:
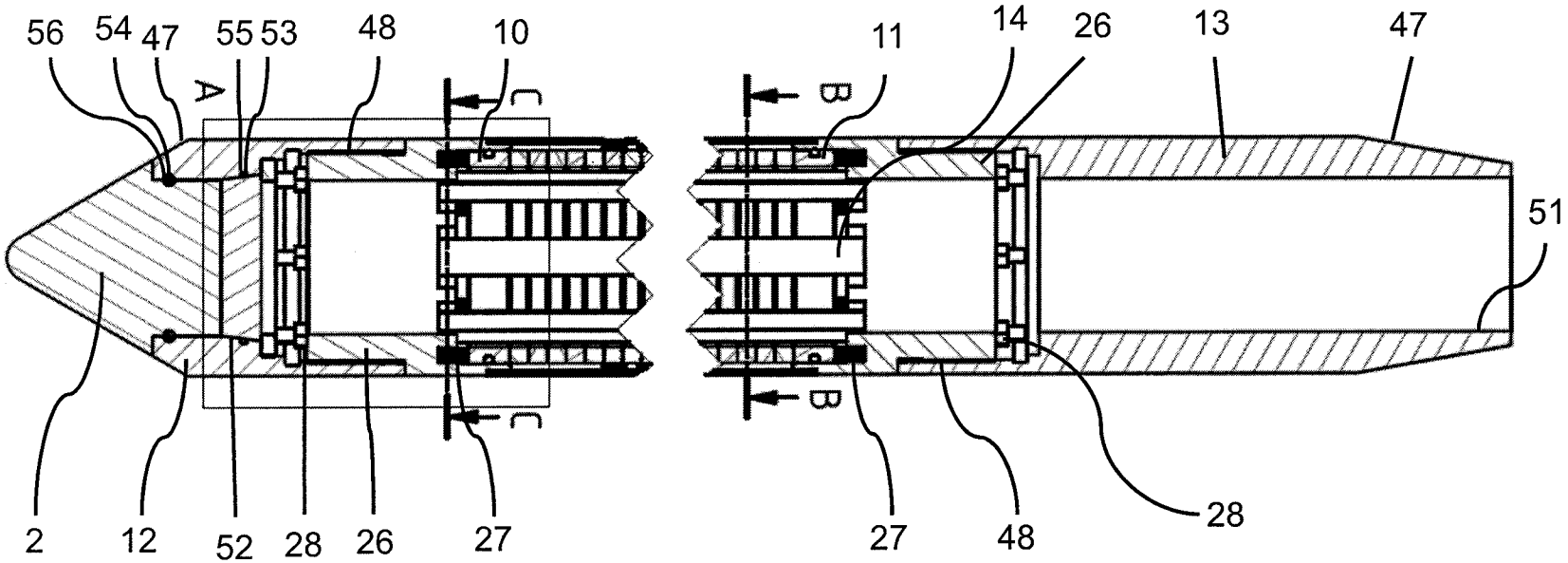
FIG. 6 shows a cross-sectional view of a separating device according to the invention as provided by a first embodiment.

The clamping device preferably comprises an upper and a lower clamping set as well as one or more clamping elements, which connect the clamping sets and run along the inner circumference of the annular stack. In the preferred embodiments, the clamping element may, for example, be realized as a clamping tube 15 (FIG. 7) or by at least three uniformly distributed clamping rods 14 (FIG. 6). The clamping set comprises a clamping bush 26, compression springs 27 (both in FIGS. 6 and 7) and clamping nuts 28 (in the embodiment with the clamping rods, FIG. 6) or a clamping ring 29 (in the embodiment with the clamping tube, FIG. 7).

The clamping device makes it possible for force to be introduced to the coupling-on elements, and consequently to the annular stack, in a controlled and uniform manner. This is achieved in large part by the at least three uniformly distributed compression springs 27. In a preferred embodiment, there are six uniformly distributed compression springs 27.

The compression springs 27 additionally allow compensation for different thermal expansions of the different materials and varying heights of the annular discs caused by production tolerances. As a result, a load distribution that is uniform throughout the service life is achieved. A uniform distribution is important, since otherwise there is an increased risk of fracture for the ceramic annular elements.

The compression springs are preferably chosen from corrosion-resistant steel, coated steel or corrosion-resistant elastomer, such as for example rubber or Viton.

The clamping elements are preferably produced from steel, more preferably from corrosion-resistant steel. Since the clamping elements run in the interior of the annular stack of brittle-hard material, they are protected by it from abrasion, and consequently the bracing within the sand filter module is ensured throughout its entire service life.

In a preferred embodiment, the clamping element is realized as a clamping tube 15 (FIGS. 7 and 9), this tube having to have throughflow openings for the extraction of oil, water and gas mixtures or the individual components thereof from deep wells. This may be a perforated or slit tube or a cylindrical perforated plate. The form, arrangement and number of the throughflow openings is determined on the one hand by the required throughflow amount and on the other hand by the desired tensile and torsional strength of the clamping tube. In a preferred embodiment in FIG. 9*a*, the throughflow openings are shaped as rounded-off slits 41. They have only been introduced into the clamping tube in the region of the annular discs; from the coupling-on segments, the circumferential surface consists of solid material. On the upper and lower circumferential surfaces of the clamping tube 15 there is preferably in each case an external thread 30 for the fastening to the clamping ring.

As an alternative to a clamping tube with throughflow openings, a coarse-meshed screen or a stiff wire mesh may also be constructed and used as a tube.

The outside diameter of the clamping tube 15 is smaller than the inside diameter of the annular discs, so that there is a gap between the clamping tube and the annular stack. The annular discs must not lie on the clamping tube, in order that external loads such as bending are not transferred from the metal clamping tube to the rings by load introduction. In order to ensure this, spacers 31 (FIGS. 9*b* and 9*c*) of an elastic, compressible polymer material are introduced between the clamping tube and the annular stack. This may take the form of a wound polymer band, polymer rings or polymer strips. Preferably, at least 3 polymer strips are used, offset from one another in each case by 120° and covering the entire length of the annular stack and the coupling-on elements, whereby the annular discs are additionally centred on the clamping tube.

In a further preferred embodiment, a number of clamping elements are present in the form of clamping rods 14 (FIGS. 6 and 8), which are uniformly distributed over the inner circumference of the annular stack. The clamping rods may be received in the clearances/grooves 20 of the annular discs and always correspond in their number to the number of clearances/grooves 20. There are preferably at least three clamping rods, more preferably six clamping rods. The number of clamping rods is chosen according to the required stress on the annular stack and the ability to absorb tensile loads of the modules resulting from the dead weight.

Figure 8A:
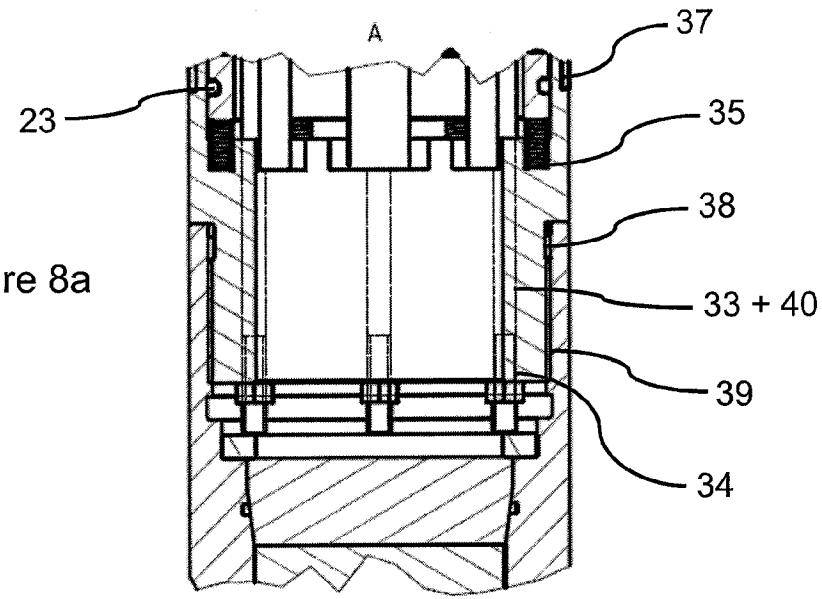
FIGS. 8*a*-8*c* show cross-sectional views of a detail of the separating device as shown in FIG. 6.
Figure 8B:
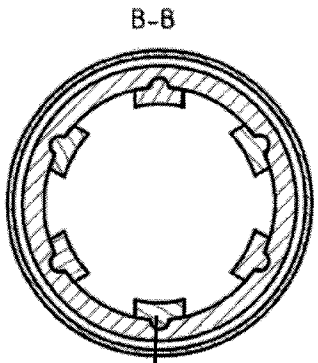
Figure 8C:
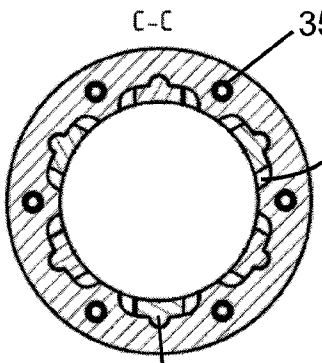

The clamping rods 14 may be configured with a round or ellipsoidal cross-sectional area. To increase the material cross section, and consequently the tensile and torsional strength, the clamping rods are preferably configured as profiled rods 32 (FIGS. 8*b* and 8*c*). The cross-sectional area of the profiled rods may, for example, correspond to that of a circular segment or, as in the preferred embodiment in FIG. 8*b* or *c*, to a combination of annular and circular segments.

The clamping rods may be provided with a powder coating, in order to avoid the steel material of the rods lying directly on the ceramic annular elements.

The connection to the clamping nuts must be possible at both ends of the clamping rods. In the preferred embodiment represented (FIG. 8*a*), the profile cross section therefore does not extend over the entire length of the clamping rods, but goes over into a round cross-sectional area 33 in the region of the clamping bushes (FIG. 8*a*). To be precise, the circular segment of the profile with a round cross-sectional area is extended. At the upper and lower ends of the clamping rods there is in each case a thread 34 (FIG. 8*a*) for the fastening of the clamping nuts.

The clamping bush on the one hand serves as a compression spring seat and has inner guides 35 (FIGS. 8*a*, 8*c*, 9*a*) for receiving the compression springs, on the other hand makes the bracing by way of the clamping element/the clamping elements possible. The clamping device is sealed from the outside, i.e. between the clamping tube and the coupling-on element, by means of O-rings (23 in FIG. 9*a*). The clamping bush is preferably produced from steel, more preferably from corrosion-resistant steel.

Figure 9A:
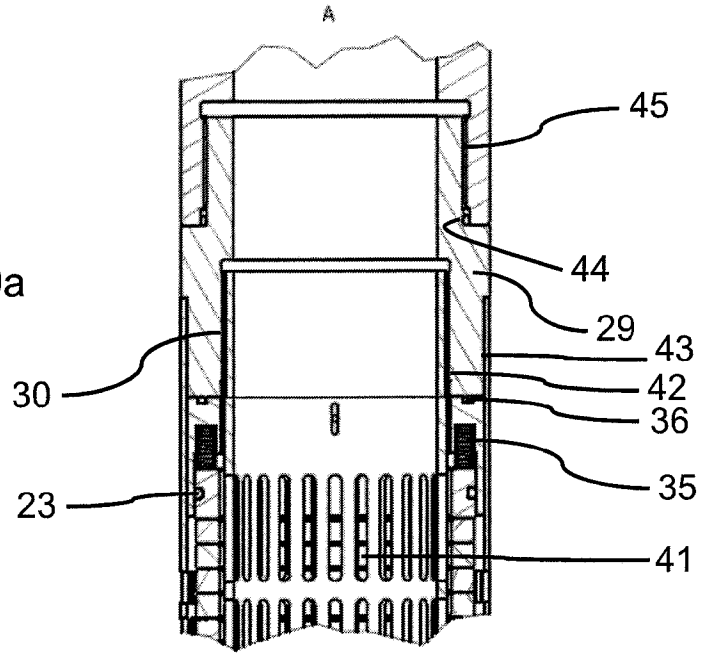
FIGS. 9*a*-9*c* show cross-sectional views of a detail of the separating device as shown in FIG. 7.
Figure 9C:
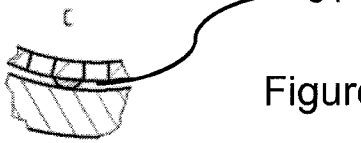
Figure 9B:
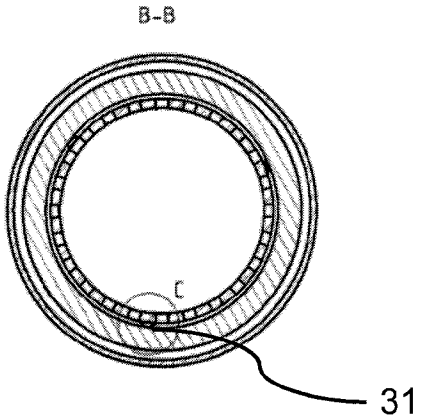

The clamping bushes are configured differently for the two preferred embodiments of the clamping elements. In the case of the embodiment in which the clamping element is realized as a clamping tube, the clamping bush is of a cylindrical construction (FIG. 9*a*). The outer cage is made to run past the outer circumferential surface, the clamping tube is made to run past the inner circumferential surface. On the surface directed towards the clamping ring there is preferably a peripheral groove for receiving a sealing ring (O-ring, 36, FIG. 9*a*).

In the case of the embodiment with the clamping rods, the clamping bush is cylindrical on the inner circumferential surface; on the outside there are three distinct regions: an outer guide 37 (FIG. 8*a*) for receiving the outer cage, a depression 38 (FIG. 8*a*) for receiving an O-ring and a thread 39 for fastening to the coupling element. In addition, in the case of this embodiment, through-bores 40 (FIG. 8*c*) for leading through the tension rods, have been introduced into the clamping bush. On the side aligned to the clamping nuts, the bores are configured as round bores, on the side aligned to the coupling-on elements they have a profile which can receive the profile of the clamping rods.

In the case of the embodiment with the clamping tube, a clamping ring (29 and FIG. 9*a*) is preferably used for the bracing. This ring is cylindrical on the inner circumferential surface and has towards the side of the annular stack a depression with an internal thread 42 for screwing to the clamping tube. On the outside there are three distinct regions: an outer guide 43 for receiving the outer cage, a depression 44 for receiving an O-ring and a thread 45 for fastening to the coupling element.

The bracing of the annular stack is performed in parallel with the assembly.

The screwing of the upper clamping ring to the clamping tube allows the annular stack to be braced in a defined manner. Since the clamping ring and the clamping bush do not enter into a connection, it is ensured that no load is transferred from the compression springs to the coupling-on elements during the bracing, and these elements remain undamaged.

The fixing of the clamping rods or the clamping tube preferably takes place by way of clamping nuts or a clamping ring, since in this way a defined tightening torque is applied and linear tolerances can be compensated. Alternative types of fastening rather than a thread and clamping nut are the combinations of a groove and a securing ring as well as a countersunk bore and a grub screw. Fastening by means of welding, clamping or shrink-fitting is also possible.

In the case of the embodiment with clamping rods, the annular stack is braced more flexibly in comparison with the embodiment with the clamping tube thanks to the clamping rods being flexible to a certain degree. Although the tensile and torsional strength are greater in the case of the embodiment with the clamping tube, sufficient tensile strength for bearing the dead load is ensured by the profile cross section of the clamping rods. The clamping rods have enough strength to prevent the construction from twisting over a large area. Minor deformations are possible, however, and allow the rings in the annular stack to move to a certain degree in the radial and tangential directions. Consequently, a buildup of stress in the annular stack caused by bending can be reduced more effectively than in the embodiment with the clamping tube.

As an alternative to the preferred embodiments of the sand filter module described, a further embodiment is conceivable, in particular for the embodiment with the clamping tube, one in which the clamping device and the coupling element are combined on one side 46 (FIG. 7) or both sides. With the combined embodiment of the clamping device and the coupling element, it is also possible to dispense with the clamping ring. In these cases, there is no longer the functional distinction between the individual components, but the bracing principle can to the greatest extent be adopted.

Outer Cage

The sand filter module according to the invention is preferably protected from damage during installation, such as for instance damage caused by impact or friction on the well casing as well as by rapidly oncoming rock particles when commencing extraction, by an outer cage 5 which can be flowed through freely (FIG. 1).

This cage may, for example, be configured as a coarse-meshed screen and preferably as a perforated plate. Preferably steel, more preferably corrosion-resistant steel, is used as the material. Alternatively, however, the use of fibre-reinforced polymer materials is also conceivable, since then the load-absorbing capacity and the resistance to torsional and flexural moments can be set according to requirements.

The outer cage lies loosely secured in the outside diameter of the clamping device, but may also be fixedly connected to the clamping device to stiffen the separating device with respect to flexural and torsional moments as well as tensile and compressive stresses. This fixing is possible, for example, by adhesive bonding, screwing, pinning or shrink-fitting; the outer cage is preferably welded to the clamping device after assembly.

Coupling Elements (for Connecting the Sand Filter Modules to Further Components of the Extraction Equipment)

The coupling elements 12, 13 (FIGS. 6 and 7) serve for connecting the braced annular stack/sand filter module to further components of the extraction equipment, such as for example the filter module tip 2 and intermediate modules. The individual sand filter modules may be connected by way of the coupling elements and intermediate modules to form filter systems of any desired length.

The coupling elements are preferably produced from steel, more preferably from corrosion-resistant steel.

Figure 7:
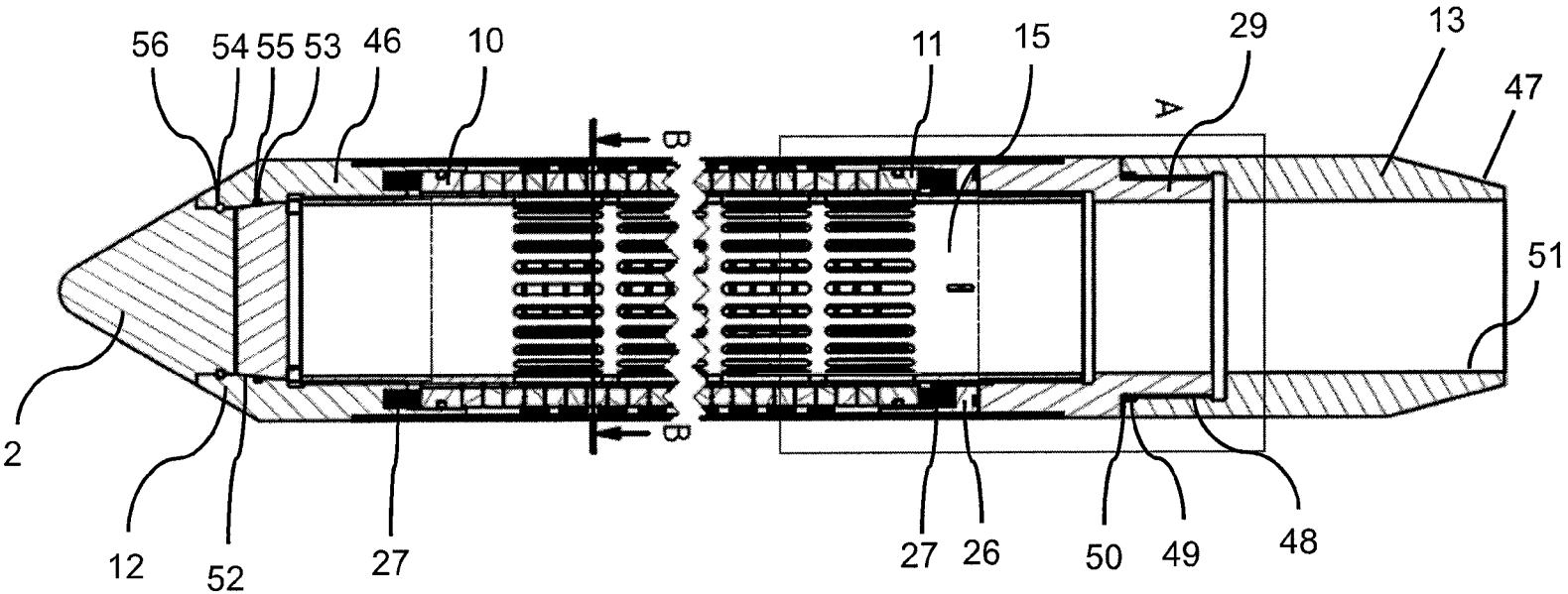
FIG. 7 shows a cross-sectional view of a separating device according to the invention as provided by a second embodiment.

They have an inside diameter identical to the clamping device and are cylindrical on the outside. Towards the intermediate module, they preferably show an outer, conical wedge surface 47 (FIGS. 6 and 7). The inner circumferential surface can be divided into three regions: in the middle region, the coupling element is tubular and has a constant wall thickness. Towards the clamping device, the tube is narrowed and the wall thickness reduced. In this region there is a thread 48 (FIGS. 6 and 7) for fastening to the clamping device. At the outer end is a further depression 49 (FIG. 7), which receives a sealing ring (O-ring). In the preferred embodiment the inner circumferential surface has an internal thread 51 on the side directed towards the intermediate module (FIGS. 6 and 7). However, it is also conceivable that the thread has been introduced into the outer circumferential surface as an external thread.

For reasons of space, coupling elements that connect to a filter module tip 2 are generally made shorter than those that receive the intermediate modules. As an alternative to a configuration with an internal thread, a configuration with an inner cone 52 (FIGS. 6, 7 and 10) and at least one peripheral groove 53, 54 (FIGS. 6, 7 and 10) for receiving a sealing ring (O-ring) 55 (FIGS. 6, 7 and 10) or a snap ring 56 (FIGS. 6, 7 and 10) is also possible here.

The length of the coupling elements that receive the intermediate modules is uncritical and should preferably be chosen rather longer, since, depending on the chosen embodiment and consequently the stiffness of the clamping device, the coupling elements and intermediate modules must additionally contribute to the absorption of external loads such as bending and the tensile loads resulting from the dead weight.

As an alternative to the preferred embodiment of the sand filter module described, with two coupling elements, a further embodiment is conceivable, in particular in the case of the clamping element with the clamping tube, one in which the clamping device and the coupling element are combined with each other at the upper and/or lower end of the sand filter module (46 in FIG. 7). In these cases, there is no longer the functional distinction between the individual components, but the bracing principle can to the greatest extent be adopted.

Protective Enclosure

The outer, conical wedge surface of the coupling elements and the intermediate modules are preferably protected from wear, caused by abrasion/erosion as a result of sand and rock particles as well as by corrosion, by one or more protective enclosures 4 (FIG. 1).

The wear protection of the aforementioned metal regions preferably takes place by means of a plastic covering, for example by means of a shrink-fit tube. However, it is also possible to achieve the wear protection by (powder) coatings, by covering mats, films or sheets, which are fixed for example by means of mechanical clamping, or else by moulded parts.

In order to prevent damage to the protective enclosure during installation, suitable spacers may be provided, it being possible for these to be realized for example as sliding nubs on the perforated plate.

The materials for the plastic covering are preferably chosen from the group of substances comprising polyolefins, preferably polyethylene, polypropylene and poly(iso)butylene, since these on the one hand have adequate resistance to abrasion/erosion and corrosion and on the other hand can be applied as a shrink-fit tube. Other possible materials for the plastic coverings or shrink-the tubes are PVDF, Viton, PVC and PTFE.

The wall thickness of the shrink-fit tubes is less than 7 mm; it typically lies in the range from 1 to 3 nm.

The use of a shrink-fit tube has the following advantages over other solutions:

- solid, impermeable coverings can be realized; a functional distinction is possible by covering with different shrink-fit tube materials. For example, a material with high erosion resistance may be applied on the outside and a material with high corrosion resistance may be applied on the inside.
- the connection to the regions to be protected is positive. Extraction or cleaning media cannot "creep" under the covering. Additional sealing of the covering is not required.

Any desired lengths can be protected by joining tube segments to one another (in an overlapping manner).

Transitions in diameter and cross section, such as here at the clamping sets, can be overcome on the basis of the shrinkage rates of up to 3:1 (change in diameter).

This is a low-cost solution, since commercially available shrink-fit tubes can be used.

Filter Module Tip with Increased Abrasion Protection

The last sand filter module, directed towards the lower end of the well, must be closable. This is realized in practice by filter module tips 2 (known as bull plugs) (FIG. 1). They are intended to ensure that the extraction of oil, water and gas mixtures or the individual components thereof from the deep well always runs via the filter modules and that the sand present in the well is held back at the filter module. In addition, however, it is necessary that the filter module tip can be opened again or removed if required. This is possible, for example, by blowing off the filter module tip. Often, lances are also used; these are inserted through the interior of the sand filter modules and push the filter module tip out with great force.

For this purpose, filter module tips are preferably configured with a material that is elastic under impact. In the prior art, metal materials are often used. However, polymer materials are also particularly suitable, preferably highly elastic polymer materials, which make it possible for the impact loads to be effectively reduced. As a result of their high elasticity, and the accompanying low hardness, all these materials are subjected to strong abrasive wearing by sand or rock particles.

The use of the abrasion-resistant, and consequently durable, sand filter modules according to the invention would be ended by this abrasive damage or destruction of the filter module tip. Therefore, filter module tips with increased abrasion resistance are used with preference in combination with ceramic sand filter modules. This abrasion protection may be realized, for example, by placing the wear protection plate 57 (FIG. 10) in the filter module tip. The wear protection plate is produced from a brittle-hard material, preferably from the same material as the rings. After abrasion of the soft tip during extraction operation, the wear protection plate prevents further abrasive wearing by sand or rock particles.

As an alternative to the use of a wear protection plate, the filter module tip may also be produced with a wear protection core of brittle-hard material. In this case, however, the tip must be provided with a preferably polymeric protective layer to respond resiliently to impact during introduction into the well.

Figure 10:
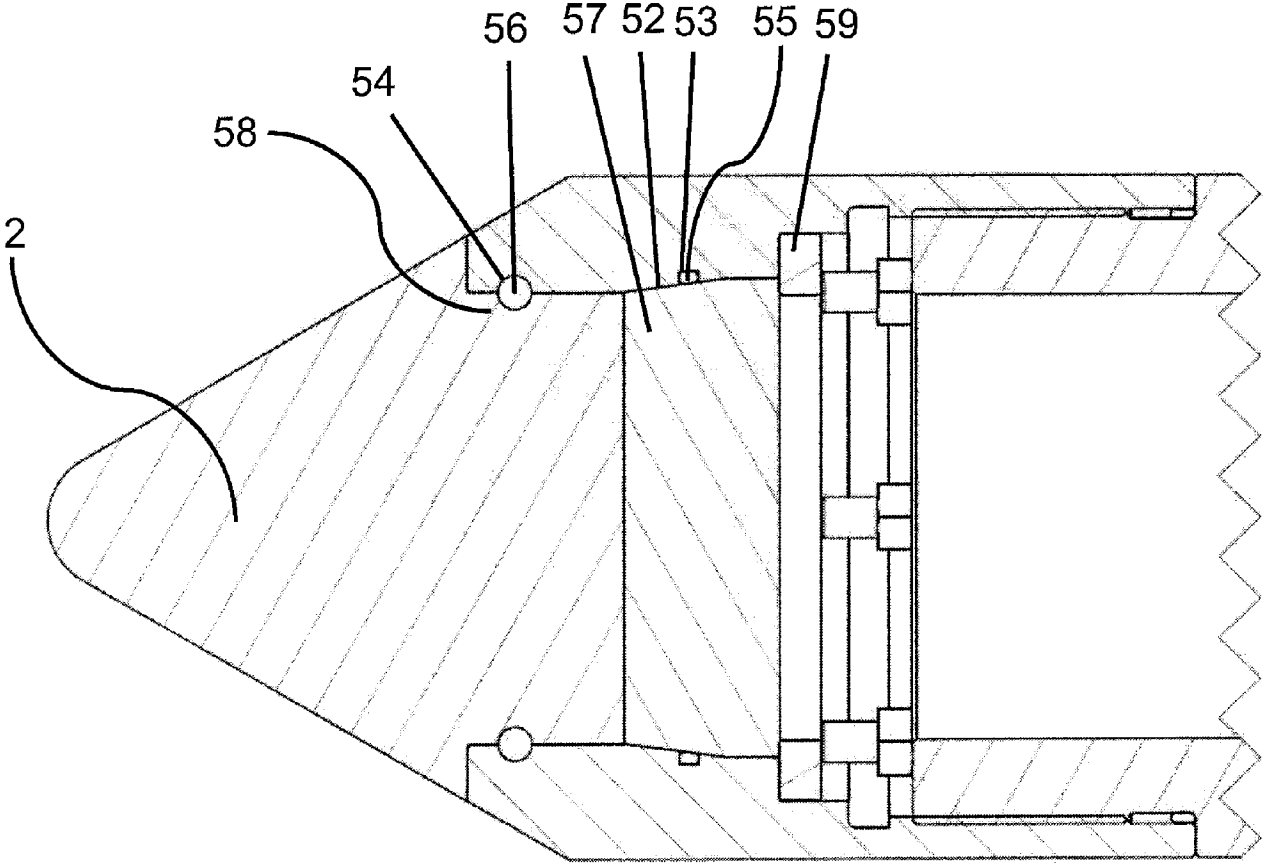
FIG. 10 shows a cross-sectional view of a filter module tip preferred according to the invention.

A preferred configuration of the filter module tip 2 with increased abrasion protection is described in FIG. 10. It is configured as solid material and substantially comprises two regions. In the rear region, facing the sand filter module, it has the form of a cylinder; in the front region, it tapers to a point. At the transition between the two regions, a peripheral groove 58 for receiving a snap ring 56 is formed.

The filter module tip is pressed into the coupling elements by means of this snap ring. Alternatively, the fastening to the coupling element may also be realized by way of a snap connection or by way of shrink-fitting.

In the embodiment suitable for ceramic, the wear protection plate 57 is preferably not completely cylindrical, but tapers conically towards the filter module tip. It can thus be fixed in the coupling element by way of a cone/cone connection 52. To increase the fastening stability, a sealing ring 55 may run between the wear protection plate and the groove 53 of the coupling element. In addition, between the wear protection plate and the clamping elements there is a spacer ring 59, which prevents the wear protection plate from hitting the clamping device under impact loads. This construction allows not only simple assembly but also pushing out of the tip by a pressure surge or lance. The pressing-out force can be varied by the size of the cone angle.

Alternatively, the wear protection plate may also be fixed by a snap or O-ring by having a shaped undercut.

In a further embodiment, the filter module tip and the coupling elements may also be combined.

Multi-Ply Filter Structure

In the case of woven metal filter meshes according to the prior art, multi-ply filter fabrics are customary and necessary for protecting the fine filter. The multi-ply fabric arrangement has the effect of increasing the flow resistance. Multi-ply fabrics also tend to become clogged by sands becoming deposited in the openings, and consequently tend to cause further increased flow resistance.

On account of the good abrasion resistance and the high deformation resistance of the brittle-hard annular stack, the ceramic sand filter modules according to the invention are of a single-ply configuration and are subjected directly to the stream extracted.

To improve the degrees of separation in the extraction of oil and gas and for specific filtering tasks in other areas, for example ultrafine filtering, however, the construction as a multi-ply filter may also be chosen.

For example, in the case of the embodiment with the clamping tube, a second filter element may be introduced between the clamping tube and the annular stack. According to the prior art, this secondary filter may be configured as a woven wire mesh, a wire winding, a slot filter or a filter sand pack or, for ultrafine filtering, also as a woven filter fabric. A variant with an inner second annular stack of brittle-hard materials can also be integrated into the construction.

In the case of the embodiment with the clamping tube, given a corresponding configuration, for example a slit tube or wire mesh, the clamping tube itself may undertake a secondary filtering function.

EXAMPLES

The following example serves for further explanation of the invention.

Example 1

Resistance to Erosion

To determine the erosive wear, plates (about 75×75×50 mm) of steel, a porous, sintered silicon carbide ceramic and fine-grained, densely sintered silicon carbide ceramic (SSiC) of the type EKasic® F (ESK Ceramics GmbH & Co. KG) were subjected to a sand blasting test. The steel specimen served in this case as a reference.

The tests were carried out by means of a sand blasting installation. Four different supporting materials that are typically used in offshore drilling operations served as blasting media: (1) 100 Mesh Frac Sand, (2) 16/20 Mesh Frac Sand, (3) 20/40 Mesh Frac Sand and (4) 20/40 Mesh Frac Sand High Strength. The blasting pressure was 2 bar and the blasting duration 2 hours, the jet being applied almost in the form of a point at an angle of 90° to the surface. The depth and width of the blasting impression characterize the erosive wear (see Table 1).

The tests show that the densely sintered silicon carbide ceramic is much more resistant to erosive wear in comparison with the porous, sintered silicon carbide ceramic and conventional steels. While the porous, sintered silicon carbide plates were found to have a hole after only 5 seconds, in the case of EKasic® F no measurable wear, or at most negligible erosive wear, could be observed even after two hours.

TABLE 1

Results of the sand blasting tests

| Example | Material | Blasting agent | Depth [mm] | Width [mm] |
|---|---|---|---|---|
| 1.1 | EKasic ® F (SSiC) | 1 | 0.1 | 14 |
| 1.2 | EKasic ® F (SSiC) | 2 | not measurable | 12 |
| 1.3 | EKasic ® F (SSiC) | 3 | not measurable | 12 |
| 1.4 | EKasic ® F (SSiC) | 4 | 0.2 | 8 |
| 1.5 | Porous SiC | 1 | 10 | 19 |
| 1.6 | Porous SiC | 2 | 10 | 16 |
| 1.7 | Porous SiC | 3 | 10 | 19 |
| 1.8 | Porous SiC | 4 | 10 | 15 |
| 1.9 | Steel (reference) | 1 | 5.3 | 17 |
| 1.10 | Steel (reference) | 2 | 0.8 | 18 |
| 1.11 | Steel (reference) | 3 | 5.3 | 18 |
| 1.12 | Steel (reference) | 4 | 4.4 | 19 |

List of reference numerals

| | |
|---|---|
| 1 | Sand filter module |
| 2 | Filter module tip |
| 3 | Intermediate module |
| 4 | Protective enclosure |
| 5 | Outer cage |
| 6 | Annular stack |
| 7 | Annular disc |
| 8 | Elevations |
| 9 | Separating gap |
| 10 | Coupling-on element |
| 11 | Coupling-on element |
| 12 | Coupling element |
| 13 | Coupling element |
| 14 | Clamping rod |
| 15 | Clamping tube |
| 16 | Upper side of the disc 7 |
| 17 | Clearance/marking groove |
| 18 | Underside of the disc 7 |
| 19 | Outer contour with bevel of the disc 7 |
| 20 | Clearances/grooves of the inner circumferential surface |
| 21 | Depressions on underside 18 |
| 22 | Peripheral groove of the coupling-on elements 10, 11 |
| 23 | Sealing ring (O-ring) |
| 24 | Clearance/marking groove |
| 25 | Clearances/grooves |
| 26 | Clamping bush |
| 27 | Compressive springs |
| 28 | Clamping nuts |
| 29 | Clamping ring |
| 30 | External thread |
| 31 | Spacer |
| 32 | Profiled rods |
| 33 | Round cross-sectional area |
| 34 | Thread |
| 35 | Inner guides |
| 36 | O-ring |
| 37 | Outer guide |
| 38 | Depression |
| 39 | Thread |
| 40 | Through-bores |
| 41 | Rounded-off slits |
| 42 | Internal thread |
| 43 | Outer guide |
| 44 | Depression |
| 45 | Thread |
| 46 | Coupling element combined with clamping device |
| 47 | Conical wedge surface |

-continued

List of reference numerals

| | |
|---|---|
| 48 | Thread |
| 49 | Depression |
| 50 | Seal/O-ring |
| 51 | Internal thread |
| 52 | Inner cone |
| 53 | Peripheral groove |
| 54 | Peripheral groove |
| 55 | Seal/O-ring |
| 56 | Snap ring |
| 57 | Wear protection plate |
| 58 | Peripheral groove |
| 59 | Spacer ring |

The invention claimed is:

1. Separating device for removing sand and rock particles which is suitable as an integral component part of extraction equipment for the extraction of liquids or gases from deep wells, the separating device comprising at least one ceramic filter module (1), the ceramic filter module (1) comprising:

a) an annular stack (6) of brittle-hard annular discs (7), the upper side (16) of which has at least three elevations (8) uniformly distributed over the circular circumference of the discs, the discs (7) being stacked and braced in such a way that a separating gap (9) for the removal of sand and rock particles is present in each case between the individual discs (7), b) a coupling-on element (10) at the upper end and a coupling-on element (11) at the lower end of the annular stack (6), c) a clamping device (14, 15) for the axial bracing of the annular stack (6), d) an outer cage (5) for the mechanical protection of the filter module (1), e) a coupling element (12) at the upper end and a coupling element (13) at the lower end of the ceramic filter module (1) for connecting the ceramic filter module (1) to further components of the extraction equipment, wherein the discs (7) are stacked and braced in the annular stack (6) such that the discs (7) are movable with respect to one another in the radial and tangential directions, and wherein the annular discs (7) comprise, at least in part, a ceramic material.

2. Separating device according to claim 1, the clamping device comprising clamping rods (14) arranged within the annular stack (6).

3. Separating device according to claim 2, the annular discs (7) having on their inner circumferential surface at least three clearances (20), which serve for receiving the clamping rods (14).

4. Separating device according to claim 2, the clamping device (14, 15) also comprising a clamping set, comprising a clamping bush (36), compression springs (27) and clamping nuts (28) for the clamping rods (14).

5. Separating device according to claim 2, the clamping rods (14) being produced from steel.

6. Separating device according to claim 5, the clamping rods (14) being produced from corrosion-resistant steel.

7. Separating device according to claim 1, the clamping device comprising a clamping tube (15) arranged within the annular stack (6).

8. Separating device according to claim 7, the clamping device (14, 15) also comprising a clamping set, comprising a clamping bush (36), compression springs (27) and clamping rings (29) for the clamping tube (15).

9. Separating device according to claim 8, the clamping tube (15) being produced from corrosion-resistant steel.

10. Separating device according to claim 7, the clamping tube (15) being produced from steel.

11. Separating device according to claim 1, said device also comprising one or more protective enclosures (4).

12. Separating device according to claim 1, said device also comprising at the lower end a filter module tip (2) with increased abrasion protection.

13. Separating device according to claim 1, the elevations (8) on the upper side (16) of the discs (7) being given the form of spherical portions.

14. Separating device according to claim 1, the annular discs (7) having on their underside (18) at least three depressions (21), in which the elevations (8) can be positioned.

15. Separating device according to claim 1, the upper side (16) of the annular discs (7) being formed at a right angle to the disc axis.

16. Separating device according to claim 1, the underside (18) of the annular discs (7) being formed sloping down outwards.

17. Separating device according to claim 1, the radial wall thickness of the annular discs (7) being at least 2 mm.

18. Separating device according to claim 17, the radial wall thickness of the annular discs (7) being at least 5 mm.

19. Separating device according to claim 1, the thickness of the annular discs (7) being 1 to 20 mm.

20. Separating device according to claim 19, the thickness of the annular discs (7) being 1 to 10 mm.

21. Separating device according to claim 1, the separating gap (9) between the individual discs (7) having a height of 0.05-1 mm.

22. Separating device according to claim 21, the separating gap (9) between the individual discs (7) having a height of 0.05-0.5 mm.

23. Separating device according to claim 1, the brittle-hard material of the annular discs (7) being chosen from group consisting of:

oxidic ceramic materials, non-oxidic ceramic materials, mixed ceramics of oxidic and non-oxidic ceramic materials, ceramic materials with the addition of secondary phases, mixed materials with fractions of ceramic hard materials and with a metallic binding phase, precipitation-hardened casting materials, powder-metallurgical materials with hard material phases formed in situ, long-fibre-reinforced ceramic materials, short-fibre-reinforced ceramic materials, and any combination thereof.

24. Separating device according to claim 1, the brittle-hard materials of the annular discs (7) having HV hardness values ≥15 GPa.

25. Separating device according to claim 24, the brittle-hard materials of the annular discs (7) having HV hardness values ≥23 GPa.

26. Separating device according to claim 1, the brittle-hard materials of the annular discs (7) having moduli of elasticity ≥200 GPa.

27. Separating device according to claim 26, the brittle-hard materials of the annular discs (7) having moduli of elasticity ≥350 GPa.

28. Separating device according to claim 1, the brittle-hard materials having a density of at least 90% of the theoretical density.

29. Separating device according to claim 28, the brittle-hard materials having a density of at least 95%, of the theoretical density.

30. Separating device according to claim 1, the brittle-hard material being sintered silicon carbide (SSiC) or boron carbide.

31. Separating device according to claim 1, the coupling-on elements (10, 11) having on their outer circumferential surface at least one peripheral groove (22) for receiving a sealing ring (23).

32. Separating device according to claim 1, the outside diameter of the coupling-on elements (10, 11) being equal to or greater than that of the annular discs (7).

33. Separating device according to claim 1, the coupling-on elements (10, 11) being produced from the same brittle-hard material as the annular discs (7).

34. Separating device according to claim 1, the coupling elements being produced from steel.

35. Separating device according to claim 34, the coupling elements being produced from corrosion-resistant steel.

36. Separating device according to claim 1, the outer cage being formed as a coarse-meshed screen or as a perforated plate.

37. Separating device according to claim 36, the outer cage being produced from steel.

38. Separating device according to claim 37, the outer cage being produced from corrosion-resistant steel.

39. Use of a separating device according to claim 1 for removing sand and rock particles in a process for extracting liquids or gases from wells drilled in rock or deep wells.

40. Separating device according to claim 1, the underside (18) of the annular discs (7) being formed sloping down inwards.

41. Separating device according to claim 1, the underside (18) of the annular discs (7) being formed sloping down inwards and concavely.

* * * * *